United States Patent [19]

DuPont

[11] 4,237,562

[45] Dec. 9, 1980

[54] MASSAGE INSTALLATION

[76] Inventor: Robert J. DuPont, 77, bis, rue Michel Ange, 75016 Paris, France

[21] Appl. No.: 60,651

[22] Filed: Jul. 25, 1979

[30] Foreign Application Priority Data

Jul. 26, 1978 [FR] France ..... 78 22189
Jul. 13, 1979 [FR] France ..... 79 18272

[51] Int. Cl.[3] ..... A47K 3/00; A61H 33/02

[52] U.S. Cl. ..... 4/543, 4/178; 128/66

[58] Field of Search ..... 4/180, 178; 128/66

[56] References Cited

U.S. PATENT DOCUMENTS

| | | | |
|---|---|---|---|
| 2,870,456 | 1/1959 | Greensides | 4/178 |
| 3,263,678 | 8/1966 | Everston | 4/180 X |
| 3,374,492 | 3/1968 | Ruderian | 4/178 |
| 3,571,820 | 3/1971 | Jacuzzi | 4/180 |
| 3,890,656 | 6/1975 | Mathis | 4/178 |
| 4,010,498 | 3/1977 | Jablonski | 4/180 |
| 4,166,296 | 9/1979 | Darrah et al. | 4/180 X |
| 4,169,293 | 10/1979 | Weaver | 4/178 |

*Primary Examiner*—Henry K. Artis
*Attorney, Agent, or Firm*—Wolf, Greenfield & Sacks

[57] ABSTRACT

A massage installation is characterized in that it includes a control unit with a distinct control channel for each of the functions to be actuated, each of these control channels including an electrically non-conducting remote control device, an electronic logic system, and a power control circuit connected to the electronic logic system by an electrically non-conducting member. The invention is particularly useful in balneotherapy treatments.

19 Claims, 8 Drawing Figures

MASSAGE INSTALLATION

The present invention relates to the construction of a balneotherapy installation utilizable, either individually by the user, or in a center of kinestherapy, balneotherapy or thalassotherapy.

The objects sought are, among others, those of assuring:

(a) for sedentary persons, a complete message of their body restoring the tone and suppleness of a physically fit man;

(b) for fatigued persons, the recovery of their lost energy;

(c) for inactive persons, through daily cures, a physical activity without effort;

(d) for bed-ridden patients, avoidance of suffering from scars and the ability to maintain, if not to improve, physical activity.

The general object sought is to invigorate, by complete massage of the body, the weakened individual, to develop the musculature, to regenerate the blood circulation, and to ensure the firmness of the flesh.

With medical advice or supervision, it is possible to follow reducing cures by heating the water of the bath, either by the addition of hotter water, or by heating of the air.

The present method has its originality in the fact of being able by oneself, whilst in a bath, to regulate according to ones needs, the intensity of the massage within the adjustable range, and with no danger of electrocution, the electrical controls being converted to a voltage of less than 12 volts.

The present invention relates to the control assembly enabling the user of the massage installation in the bath, to control the different parts of the installation whilst being strictly protected against any risk of electrocution.

This control assembly must notably permit:

- the energizing of all of the electrical units of the installation,
- the variation of the speed of the turbine or the variation of the intensity of the air jets ensuring the massage,
- the placing in operation as desired of the heating resistor and the ozone generator,
- the placing in operation of the general ventilation of the bathroom,
- and in addition, there is provided a bell unit which can operate in any circumstance.

To enable the user of the installation to ensure these different controls from the bath without running the least risk of electrocution, the invention provides for the installation to include a control assembly comprising a separate control channel for each of the functions to be controlled, each of these control channels including successively a remote control device of an electronic logic system, an electronic logic system activating a power control circuit, and a power control circuit, the remote control device of the electronic logic system being electrically non-conducting in nature and the electronic logic system being connected to the power control circuit by an electrically non-conducting transmission member, and a photocoupler.

According to another feature of the invention, there is also provided a display device of the state of the various control channels.

The remote control device of the electronic logic system may be a pneumatic device, only including, for example, pressure switches each controlled through a pneumatic push-button to which it is connected through an electrically non-conducting flexible tube. However, the remote control device of the electronic logic system may also be an optical device including, for example, occultation switches each enabling the interruption or the establishment of the passage of light between the ends of two sections of optical fiber whose other ends are respectively connected thereto in the vicinity of the electronic logic system to a light source and to a photoelectric cell.

This remote control device not including any electrically conducting part, enables the complete isolation of the occupant of the bath who uses the control unit, from all parts of the installation under voltage including the electronic system supplied with low voltage. For greater safety the energized parts of the installation including the electronic system are arranged outside of the bathroom or, in any case, outside of the standard protective space in this bathroom.

To further increase the safety, the electronic logic system supplied by low voltage, is itself insulated with respect to the other installation units supplied with a higher voltage, such as the motor of the turbine, the heating resistor, the ozone lamp, as well as their power control units. This additional installation is, for example, provided by the interposition of a photocoupler between the electronic logic system and these different units at higher voltage.

By way of additional precaution, the grounding of the electronic logic system supplied with low voltage is separate from the grounding of the units of the installation supplied at higher voltage.

This set of precautions, which goes far beyond the requirements of safety standards, enables any risk to be entirely eliminated for the user of the installation.

BRIEF DESCRIPTION OF THE DRAWINGS

The invention is illustrated by way of non-limiting example in the accompanying drawings, in which.

DESCRIPTION OF A PREFERRED EMBODIMENT

Figure 1:
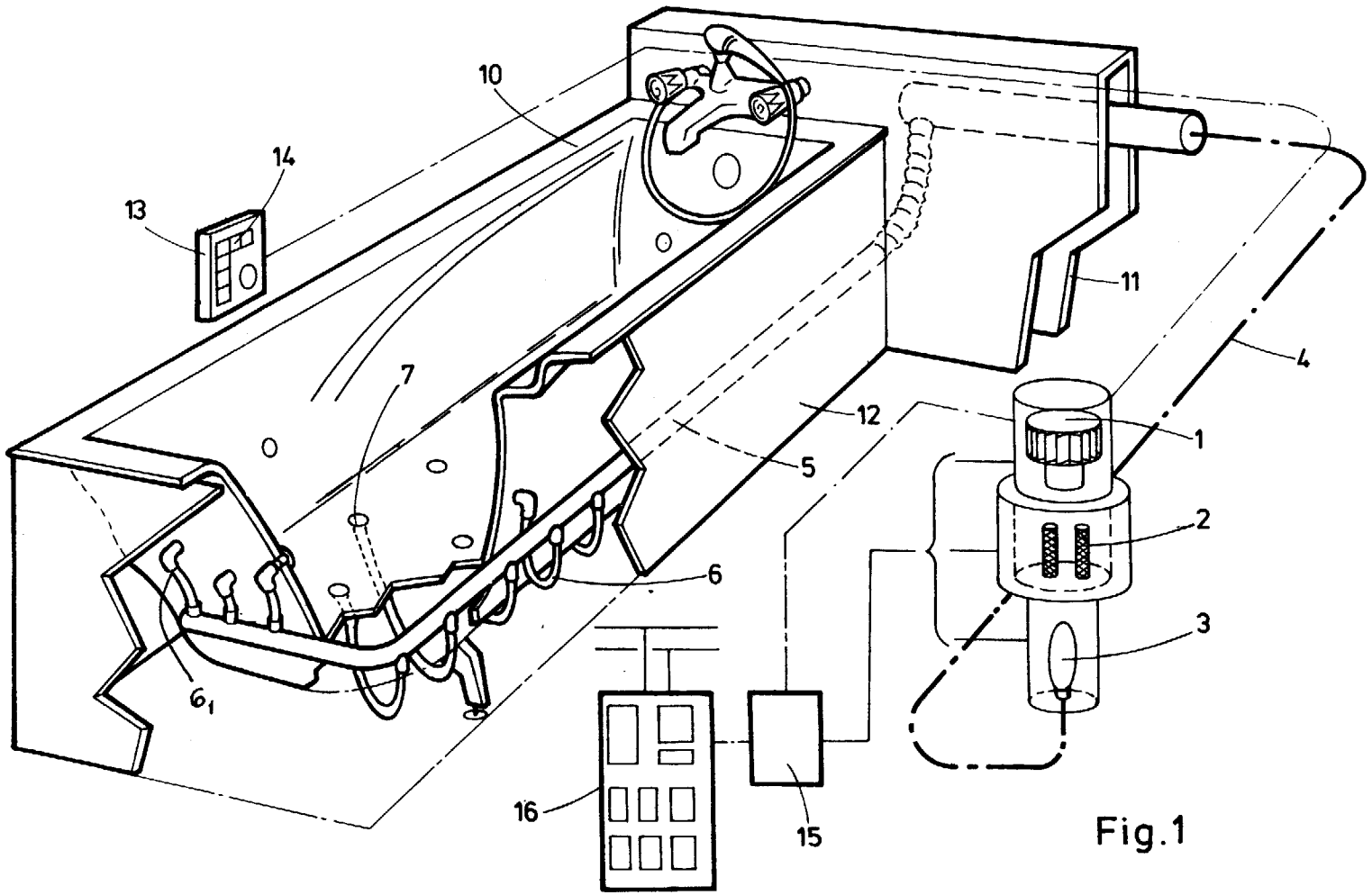
FIG. 1 is a perspective view of the installation.
Figure 4:
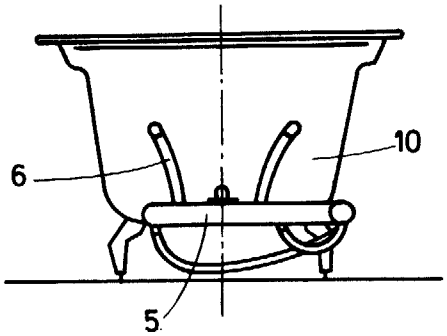
FIG. 4 is a view from the right of FIG. 3.
Figure 5:
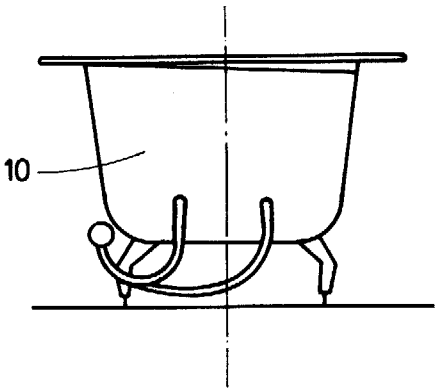
FIG. 5 is a view from the left of FIG. 3.
Figure 3:
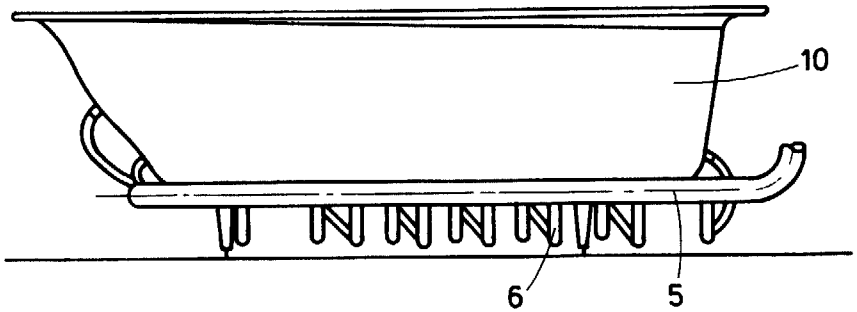
FIG. 3 is a side view showing the connectiions to the bath.
Figure 2:
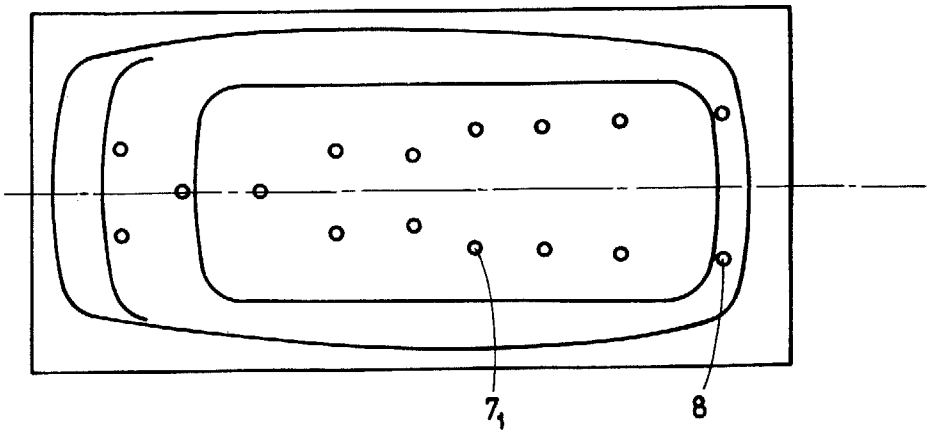
FIG. 2 is a top view of the bath.

The installation, shown in the accompanying drawings, shows a bath 10, either of enameled iron, or of hard synthetic material, enabling the injection of air under pressure through directional or fixed jets 7, at locations determined as a function of the applications desired.

The installation according to the invention is composed of a generator, an air distributing manifold and pipes opening principally but not exclusively in the bottom of the bath 10.

The generator includes three stages composed of a turbine 1 with adjustable power and of delivery rate adapted to the needs, an air heater 2 of variable power and an ozone lamp 3.

The generator 1, 2, 3 supplies, through a pipe of average cross-section 4, an air-distributing manifold 5 located above the level of the drain of the bath 10 so as to avoid to the maximum the deposition of residual water. It includes a group of pipes 6 connected to pipes $6_1$ for the passage of air.

The duct 4 can be connected to the manifold outside of a wall 11, the manifold being extended parallel to the bath 10 under the casing 12.

The pipes $6_1$ have the purpose of accelerating the air movement and assure, consequently, vigorous mixing of the water and perfect simulation of manual massage in a more intensive form. They must necessarily be used:

(a) during the bath, (b) for a brief moment after the draining of the bath.

The nozzles 7, arranged at the end of the pipes $6_1$, enable the air jets to be oriented, which are, according to their implantation, vertical (at $7_1$ through the bottom of the bath) and horizontal (at 8 through the lateral walls). Also, these nozzles 7 may be directionally positioned according to the human form and with a variable flow rate according to the desires of the user.

The orientation and the power are hence adapted according to the desired end.

The pipes $6_1$ could comprise nozzles of various diameters in order to calibrate the force of the air jets.

Also, the end side walls of the bath are provided with nozzles producing inclined air jets, directed, for some, towards the sole of the feet, for others towards the nape and the upper part of the back of the occupant of the bath.

Thus, in the example shown, the head of the bath is provided with three nozzles, whereas the foot is provided with two nozzles.

They are supplied individually with pressurized air through pipes 6 of small diameter, placed in parallel on the manifold 5. The arrangement of the pipe 6 on the manifold 5 of greater diameter enables the provision of air jets of variable delivery rate according to the diameter of the nozzle.

The manifold 5 is arranged at a level higher than that of the bottom of the bath, that is to say at a level higher than that of the drain plug hole.

A control box 13 ensures the operation of the various units of the device. It has controls:

for the turbine 1 and, consequently, for its motor, for the heater 2 composed of several electrical resistors, for the ozone control 3, for the signal bell, for the extractor for the removal of possible mists, for the heating of the premises.

This box 13, situated close to the bath, includes switches 14, each connected to a 12 volt relay, a relay cabinet 15 inserted in the supply circuit of the aforesaid units, this supply being ensured through a general electrical cabinet 16.

This balneotherapy installation then enables effective massage to be obtained through air jets of suitable force and temperature, the beneficial effect of these air jets being in addition improved by the presence of ozone.

The present installation can receive, in addition, adjuvants such as:

seaweed pastes, powdered aromatic plants, perfumes of any nature, with the exclusion of all foam baths or of dried herbs and plants dried or in the natural state.

Figures 6, 6A:
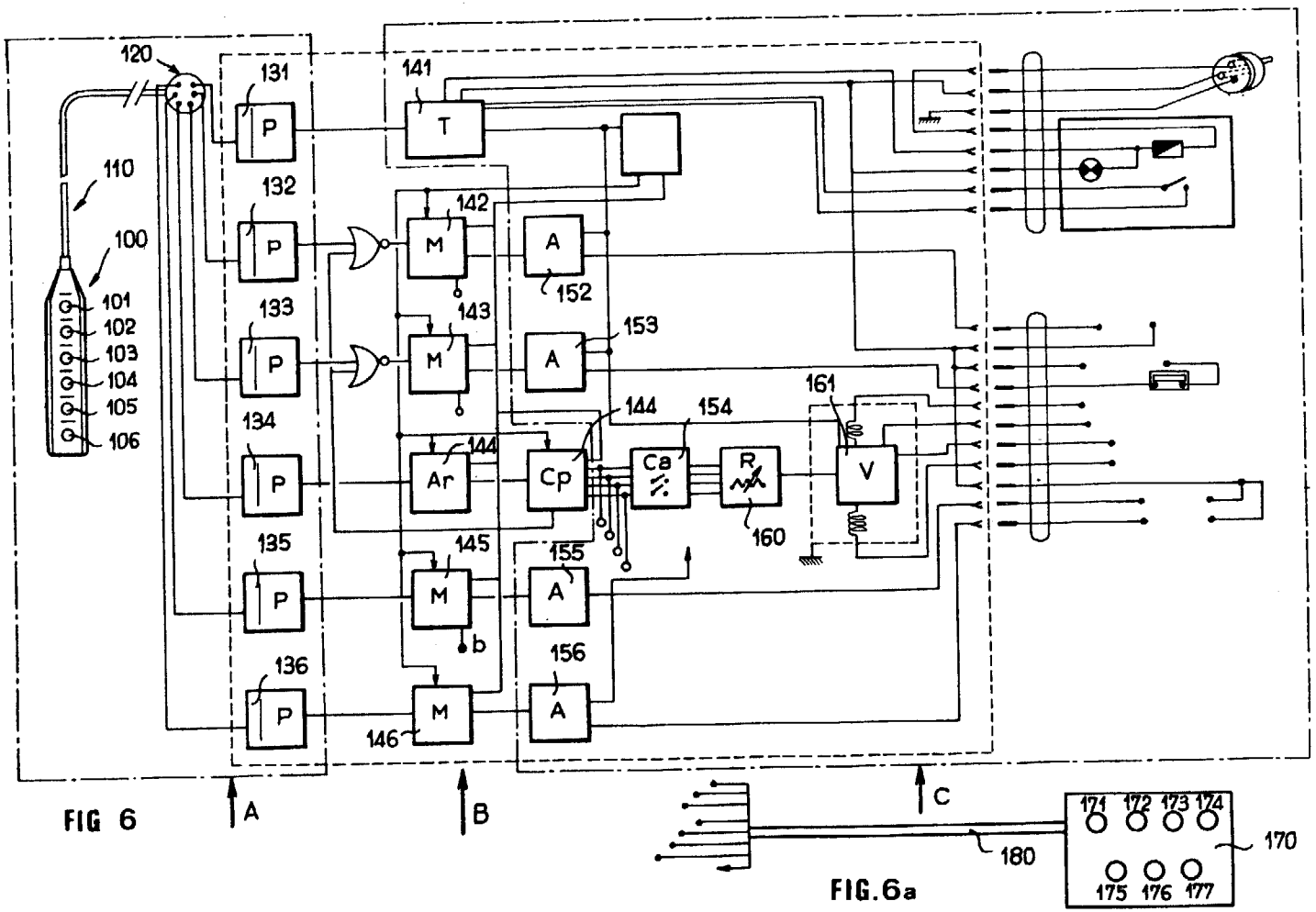
FIG. 6 is a block diagram of the control system according to the invention.
FIG. 6*a* shows the alarm device.

In FIG. 6, there is framed respectively in dashes-dots the remote control device A of the electronic logic system, and the power control circuit C. Between the two, is found the electronic logic system B unframed.

On the left of FIG. 6 is shown the control box 100 including six pneumatic push-buttons namely, the button 101 to actuate the signaling device, the button 102 to actuate the ventilation of the bathroom, the button 103 to actuate the ozone, the button 104 to actuating the heating of the air, the button 105 to regulate the speed of the turbine and finally the button 106 for the placing under voltage or the general disconnection of the voltage.

Each of the buttons 101 to 106 actuates a bellows, which is connected to a flexible polyvinyl chloride (PVC) tube, these six PVC tubes being assembled in a common sheath 110 and ending, through a distributor 120, at pressure switches 131 to 136.

The pressure switches 131 to 136 could be placed outside of the bathroom or at least outside of the standard safety space inside this bathroom.

In the present embodiment, the remote control device of the electronic logic system is pneumatic in nature, but it could also well be optical in nature. Each of the pneumatic push-buttons 101 to 106 would then be replaced by an occultation switch enabling the establishment or interruption as desired of the passage of light between the ends of two optical fiber sections of which the other ends, placed in the vicinity of the electronic logic system, would respectively be connected, one to a source of light and the other to a photo-electric cell.

The electronic logic system will be described in more detail from FIG. 7 and it has simply been shown in FIG. 6 in its essential elements, namely: storages or memories 142, 143, 145 and 146 respectively associated with the control channel of the ozone, of the heating resistor, of the general ventilation and of the sound signal whilst the control for the regulation of the air flow includes a counter 144 and, connected upstream of the latter, an anti-rebound device 144'.

The power control circuits include essentially triac control devices 152, 153, 155 and 156 respectively associated with the control of the ozone, of the heating resistor, of the general ventilation, and of the alarm, whilst there is provided for the regulation control of the air delivery rate a commutator 154 controling a set of resistors 160 to actuate the speed variator 161 of the motor of the turbine. The general control for switching on or off the power is ensured by telebreaker 141.

FIG. 6*a* shows the display panel 170 including the start-stop signal lamp 171, the signal lamps indicating the air delivery 172 to 174, the signal lamp 175 for the heating, the lamp 176 for the ozone and the lamp 177 for the ventilation. These various signal lamps are preferably provided different in color and appearance to enable them to be identified. This display board is placed in the bathroom outside the standard safety area, well in view of the occupant of the bath. It is connected by eight wire cabling 180 to the electronic logic system as will be described in more detail below.

The constitution and the operation of the various control channels will now be described in more detail with reference to FIGS. 6 and 7.

Figure 7:
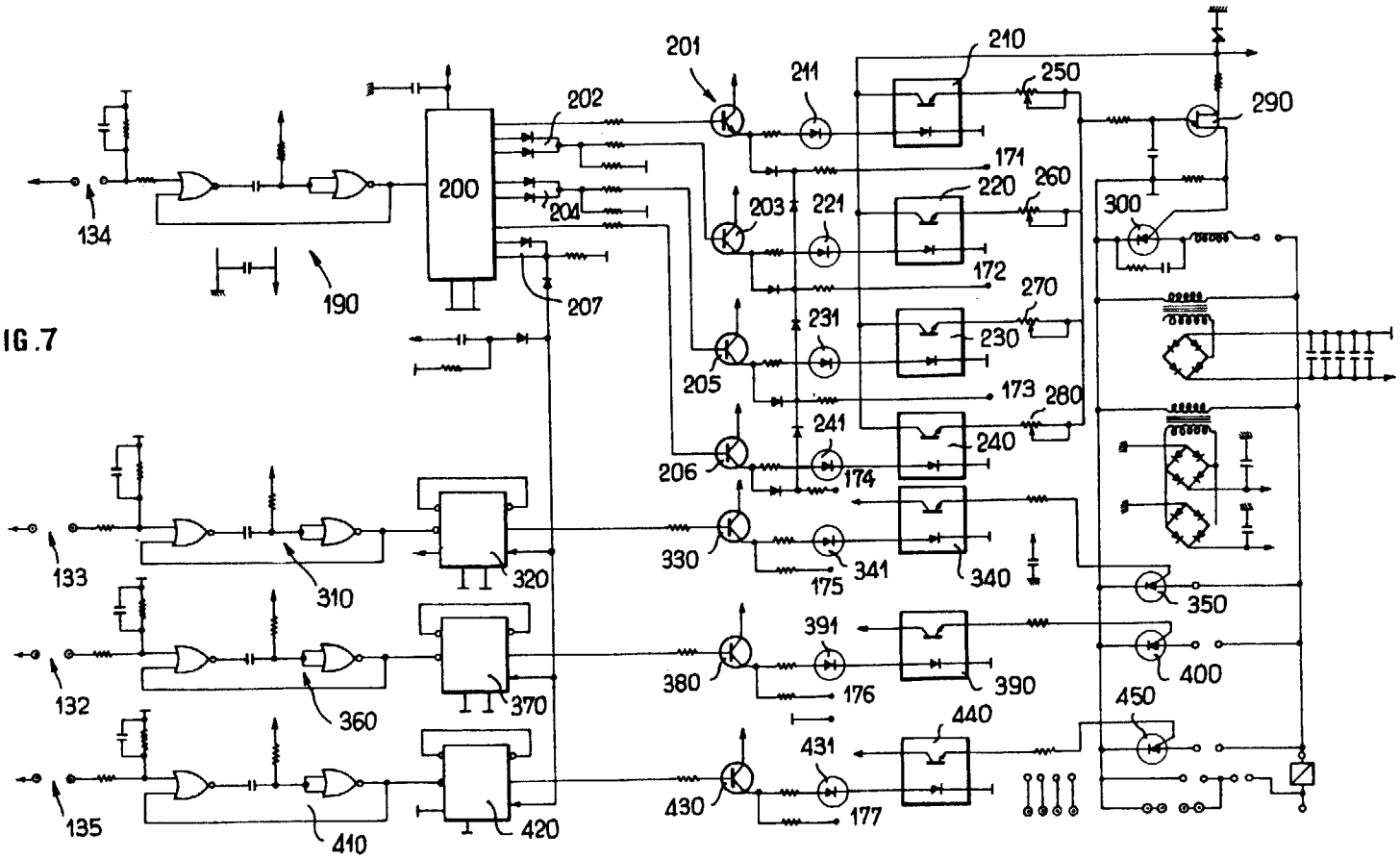
FIG. 7 is a more detailed diagram of the control system of FIG. 1.

The connection and disconnection of the general voltage is controlled by the pressure switch 131 (not shown in FIG. 7 which emits a pulse causing the closing of the contacts of the telebreaker 141. A further pulse emitted by the pressure switch 131 will cause the opening of the contacts of the telebreaker 141 and so on.

The operation of the control channel of the air delivery rate adjustment from the pressure switch 134 will now be described. This pressure switch delivers a pulse of any duration and amplitude to the monostable stage 190. The latter converts this pulse into an output pulse of predetermined amplitude and duration which feeds the counter 200. On applying voltage to the installation, the counter 200 is automatically reset to zero. The detection of this zero state by the transistor gate 201 causes the supply of the photocoupler 210 and also causes the supply of a luminescent diode 211 in the box of the electronic logic system, as well as the diode 171 on the display panel.

A first pulse coming from the pressure switch 134 causes, through the anti-rebound monostable stage 190, the passage of the counter 200 to the state 1 which is decoded by the diode OR 202 and causes the transistor 203 to change to the conducting state, which actuates the photocoupler 220 and feeds the luminescent diode 221 on the box of the electronic logic system, as well as the luminescent diode 172 on the display panel. A second pulse coming from the pressure switch 134 causes the passage of the counter to state 2, decoded by the OR gate 204 which renders the transistor 205 conducting actuating the photocoupler 230 as well as the luminescent diode 231 and 173. A third pulse coming from the pressure switch 134 causes the counter 200 to pass to the counter state 3 which, decoded by the transistor gate 206 actuates the photocoupler 240 as well as the luminescent diodes 241 and 174.

The following pulse No. 4 causes the counter 200 to pass through the state 4 which is decoded by the OR gate 204 and controls the photocoupler 230 as well as the luminescent diodes 231 and 173, whilst the photocoupler 240 and the luminescent diodes 241 and 174 are reset to zero. The situation which was caused by the second pulse is thus restored. In the same way, the following pulse No. 5 will actuate the photocoupler 220, the luminescent diodes 221 and 172 will reset the photocoupler 230 to zero as well as the luminescent diodes 231 and 173, and the situation caused by the first pulse will thus be re-established. The following pulse No. 6 is decoded by the gate 207 and resets the counter to the zero state, which causes the actuation of the photocoupler 210 and of the luminescent diodes 211 and 171 by a resetting to zero of the photocoupler 220 and the luminescent diodes 221 and 172. The starting situation caused by the placing of the installation under voltage is thus restored, and if actuation is continued, through the push-button box, the pressure switch 134, the sequence which has just been described is repeated as a cycle every six pulses.

Thus, through the pressure switch 134, it is possible to actuate selectively one of the photocouplers 210, 220, 230, or 240, which enables the placing in circit selectively of one of the resistors 250, 260, 270 or 280. If is thus possible to actuate selectively through the transistor 290 the triac 300 equipping the speed variator of the motor of the turbine.

There will now be described, by way of example, the operation of the heating control through the pressure switch 133. Through the anti-rebound monostable stage 310, a pulse coming from the pressure switch 133 actuates the trigger circuit 320 used in the storage and whose state is decoded by the transistor 330 which supplies the photocoupler 340 and the luminescent diodes 341 and 175. The storage 320 is reset to zero on the placing of the installation under general voltage and can only be set in state 1 if the turbine operates.

The photocoupler 340 controls a triac 350 which supplies the heating resistor with power.

The control channels of the ozone and of the general ventilation have an operation identical with that which has just been described for the control channel of the heating. Thus for the control channel of the ozone, the pressure switch 132 actuates through the monostable stage 360 the memory 370 which actuates through the transistor 380 the photocoupler 390, as well as the luminescent diodes 391 and 176, the photocoupler 390 actuating the triac 400 which supplies the ozone lamp with power. In the same way the pressure switch 135 actuates through the monostable stage 410 the storage 420 which actuates through the transistor 430 the photocoupler 440 and the luminescent diodes 431 and 177, the photocoupler 440 actuating the triac 450 which supplies the general ventilation with power.

The control of the signaling device, not shown in FIG. 7, can of course operate according to a system identical with that which has just been described.

I claim:

1. Massage installation comprising a bath, air jet nozzles, said nozzles opening through the bottom and sidewalls of the bath, means producing air to said nozzles, air heating means and an ozone producing means, a casing for said air producing means, heating means and ozone producing means, and means for conducting air from said producing means to said jet nozzles whereby said heated, ozone laden air may be pumped under pressure into said bath.

2. Installation according to claim 1, wherein said nozzles are supplied individually through pipes connected in parallel to a duct supplied by the air producing means.

3. Installation according to claim 1, wherein the bath includes air jet nozzles opening on the lateral walls of the ends of the bath.

4. Massage installatiion comprising a bath, air jet nozzles, said nozzles opening through the walls of the bath, a casing means for supplying air to said nozzles, air heating means, and ozone means generating means arranged in said casing, said nozzles being supplied individually through pipes connected in parallel to a duct supplied by said means for supplying air, a control unit comprising a separate control channel for each of the functions to be controlled, an electronic logic system, each of said control channels coding successively a remote control device of the electronic logic system, a power control circuit, and the electronic logic system activating said power control circuit, and an electrically non-conducting transmission unit, the remote control device of the electronic logic system being by nature electrically non-conducting and the electronic logic system being connected to the power control circuit through said transmission unit.

5. Installation according to claim 4, comprising six control channels, namely:

a channel for the general application of voltage, a speed selection channel for the air supply means, a channel for the energizing of the air heating means, a channel for the energizing of the ventilator of the bathroom, and a channel for the energizing of the sound signal device.

6. Installation according to claim 4, provided also with a display device for the state of the various control channels.

7. Installation according to claim 4, wherein the remote control device of the electronic logic system is a pneumatic device.

8. Installation according to claim 4, wherein the remote control device of the electronic logic system is an optical device.

9. Installation according to claim 7, wherein the pneumatic device comprises a pneumatic push-button, a flexible coupling tube of electrically non-conducting material contained in the flexible sheath of variable length fixed to the control casing by a threaded nut and a pressure switch.

10. Installation according to claim 8, wherein the optical device comprises an occultation switch enabling the passage of light between the ends of the two sections of optical fiber to be interrupted or established, the other ends of these sections, on the electronic logic system side being respectively connected to a light source and to a photo-electric cell.

11. Installation according to claim 4, wherein the transmission unit connecting the electronic logic system to the power control circuit is a photocoupler.

12. Installation according to claim 4, wherein one control channel at least is provided with an anti-rebound device.

13. Installation according to claim 4, wherein the general voltage application channel includes tele-breaker.

14. Installation according to claim 4, wherein the electonic logic system of the selection of channel of the speed of the air supply means includes a monostable stage actuated by the remote control device of the electronic logic system, a counter fed by pulses delivered by this monostable stage and including as many counting states as speed levels are provided for the air supply means a decoding stage for each counting state of the counter, a control resistor and a photocoupler associated with each decoding stage.

15. Installation according to claim 4, wherein the electronic logic system of at least one control channel includes a monostable stage actuated by the remote control device of the electronic logic system, a storage actuated by this monostable stage, a decoding stage of the storage, a control transistor and a photocoupler associated with this decoding stage.

16. Installation according to claim 4, wherein the electronic logic system of each control channel includes a luminescent diode.

17. Installation according to claim 4, wherein the power control circuit of one at least of the control channels includes a triac.

18. Installation according to claim 4, wherein the sound signal device is connected upstream of the general voltage circuit breaker of the installation.

19. Installation according to claim 4, wherein the ventilator of the bathroom is provided with a manual to-and-fro control coupled with the control channel of the installation.

* * * * *